US006994304B2

(12) United States Patent
Kim et al.

(10) Patent No.: US 6,994,304 B2
(45) Date of Patent: Feb. 7, 2006

(54) UTENSIL SUPPORT APPARATUS

(76) Inventors: Chung Han Kim, 1948 W. Southgate Ave., Fullerton, CA (US) 92833; Jung Hee Kim, Ju Kong Apt. 1910 #408, Chang-Li Dobong-Ku, Seoul (KR); Yeon Suk Kim, Ju Kong Apt. 1910 #408, Chang-Li Dobong-Ku, Seoul (KR)

( * ) Notice: Subject to any disclaimer, the term of this patent is extended or adjusted under 35 U.S.C. 154(b) by 0 days.

(21) Appl. No.: 10/745,772

(22) Filed: Dec. 24, 2003

(65) Prior Publication Data

US 2005/0077442 A1 Apr. 14, 2005

(30) Foreign Application Priority Data

Oct. 8, 2003 (KR) ..... 20-2003-0031600

(51) Int. Cl.
*A45D 19/04* (2006.01)

(52) U.S. Cl. ..... 248/174; 248/37.3; 40/124.06; 40/539; 40/674

(58) Field of Classification Search ..... 248/174, 248/459, 37.3; 211/70.7; 206/55.3; 40/124.01, 40/124.06, 124.19, 539, 674, 661.12, 331
See application file for complete search history.

(56) References Cited

U.S. PATENT DOCUMENTS

| | | | | |
|---|---|---|---|---|
| 2,941,773 | A * | 6/1960 | Rosenbacher | 248/174 |
| 3,263,820 | A * | 8/1966 | McFadden et al. | 211/60.1 |
| 4,770,379 | A * | 9/1988 | Estvold | 248/110 |
| 4,834,328 | A * | 5/1989 | Hall | 248/37.3 |
| 4,858,863 | A * | 8/1989 | Lin | 248/174 |
| 4,940,199 | A * | 7/1990 | Hall | 248/37.3 |
| 5,297,677 | A * | 3/1994 | Burian et al. | 206/362.4 |
| 5,299,835 | A * | 4/1994 | Sonnenberg | 283/56 |
| 5,411,141 | A * | 5/1995 | Bounds | 206/553 |
| 5,633,054 | A * | 5/1997 | Hollinger, Jr. | 428/34.2 |
| 5,810,411 | A * | 9/1998 | Major | 294/99.2 |
| 6,604,714 | B1 * | 8/2003 | Hall | 248/37.3 |

FOREIGN PATENT DOCUMENTS

JP 2000139658 A * 5/2000

* cited by examiner

*Primary Examiner*—Korie Chan
(74) *Attorney, Agent, or Firm*—Lee, Hong, Degerman, Kang & Schmadeka

(57) ABSTRACT

Disclosed is a utensil support apparatus constructed of paper and includes a main body and a utensil supporting section formed on the main body. The utensil supporting section is folded upwards along a lateral edge and a pair of outer sections formed on the utensil supporting sections is folded to prop the utensil supporting section. A detachable advertising section is formed on the main body for removal after use of the utensil support apparatus.

9 Claims, 5 Drawing Sheets

UTENSIL SUPPORT APPARATUS

CROSS REFERENCE TO RELATED ART

Pursuant to 35 U.S.C. § 119(a), this application claims the benefit of earlier filing date and right of priority to the Korean Application No. 2003-0031600, filed on Oct. 8, 2003, the content of which is hereby incorporated by reference herein in its entirety.

BACKGROUND OF THE INVENTION

1. Field of the Invention

The present invention relates to a utensil support apparatus, and, more particularly, to a disposable eating utensil support apparatus having advertising capabilities.

2. Description of the Related Art

Generally, restaurants and eating establishments place conventional eating utensils such as knives, forks, spoon, chopstick, and the like on the surface of a dining table or counter. Often, some establishments place the eating utensils on a napkin so that utensils are not in contact with a table surface, which may be bare and without linen or disposable table cloths. Consequently, foods and liquids that are deposited onto a table's surface from used eating utensils as well as from spillages, may remain and come into contact with a restaurant eating utensils. The contact between eating utensils and deposited food stuffs is generally unsanitary and provides discomfort to the diner.

Referring to FIG. 1, a sanitary utensil supporter 21 according to the related art is shown. Such supporters are generally placed adjacent to plates at a table setting in more refined eating establishments. Generally, such supporters are used to prevent contact between used utensils, which may have food stuffs adhered to them, and the table top while new plates are provided to the patron. The supporter 21 may include grooves 22 and 23 to accommodate utensils 10.

Utensil support apparatuses such as the supporter 21 in FIG. 1 are more commonly found in more refined eateries. These apparatuses are often ornate and constructed of porcelain, polymers, or metal. However, for more economical eating establishments, providing utensil supporters would prove to be costly with respect to acquisition, cleaning, storage and care of the supporters.

Therefore, an improved solution is needed to provide a utensil support apparatus that is economical and sanitary.

SUMMARY OF THE INVENTION

Accordingly, the present invention is directed to a utensil support apparatus that substantially obviates one or more problems due to limitations and disadvantages of the related art above.

An object of the present invention is to provide a utensil support apparatus that is economical and sanitary.

Another object of the present invention is to provide a utensil support apparatus that supplements an eating establishment's income by providing advertising services.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, there is provided a utensil support apparatus comprising a main body and a utensil supporting section formed on the main body. The apparatus may be comprised of cellulose pulp and may further comprise an advertising section that may be separable.

According to one aspect of an embodiment of the present invention, the utensil supporting section comprises a first lateral edge that is separable from the main body; a pair of opposing, longitudinal edges that is separable from the main body; and a second lateral edge, wherein the utensil supporting section is folded at the second lateral edge so that the utensil supporting section is approximately perpendicular to the main body. Furthermore, creases may be formed at the second lateral edge and approximate to each opposing, longitudinal edge, which may form a pair of outer sections to be folded approximately perpendicular to a central section of the utensil supporting section.

According to one aspect of an alternative embodiment of the present invention, at least one groove is formed on the first lateral edge to accommodate at least one utensil.

It is to be understood that both the foregoing general description and the following detailed description are exemplary and explanatory and are intended to further describe the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

In the drawings.

Features, elements, and aspects of the invention that are referenced by the same numerals in different figures represent the same, equivalent, or similar features, elements, or aspects in accordance with one or more embodiments.

DETAILED DESCRIPTION OF THE PREFERRED EMBODIMENTS

Reference will now be made in detail to one or more embodiments of the invention, examples of which are illustrated in the accompanying drawings.

Figure 1:
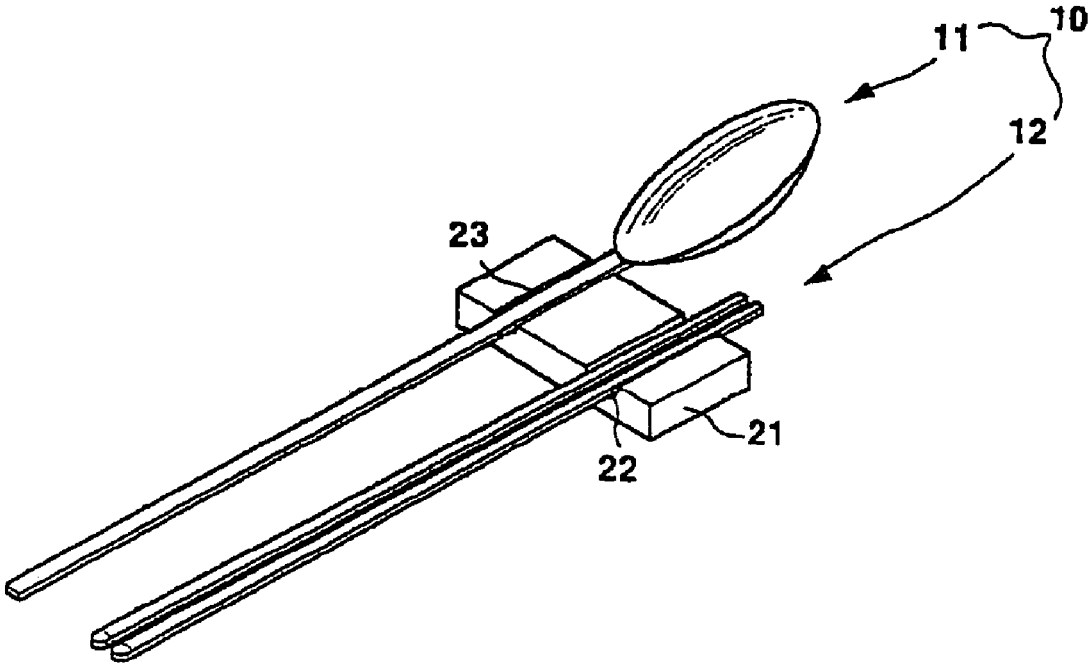
FIG. 1 (RELATED ART)
FIG. 1 illustrates a utensil support apparatus according to the conventional art.
Figure 2:
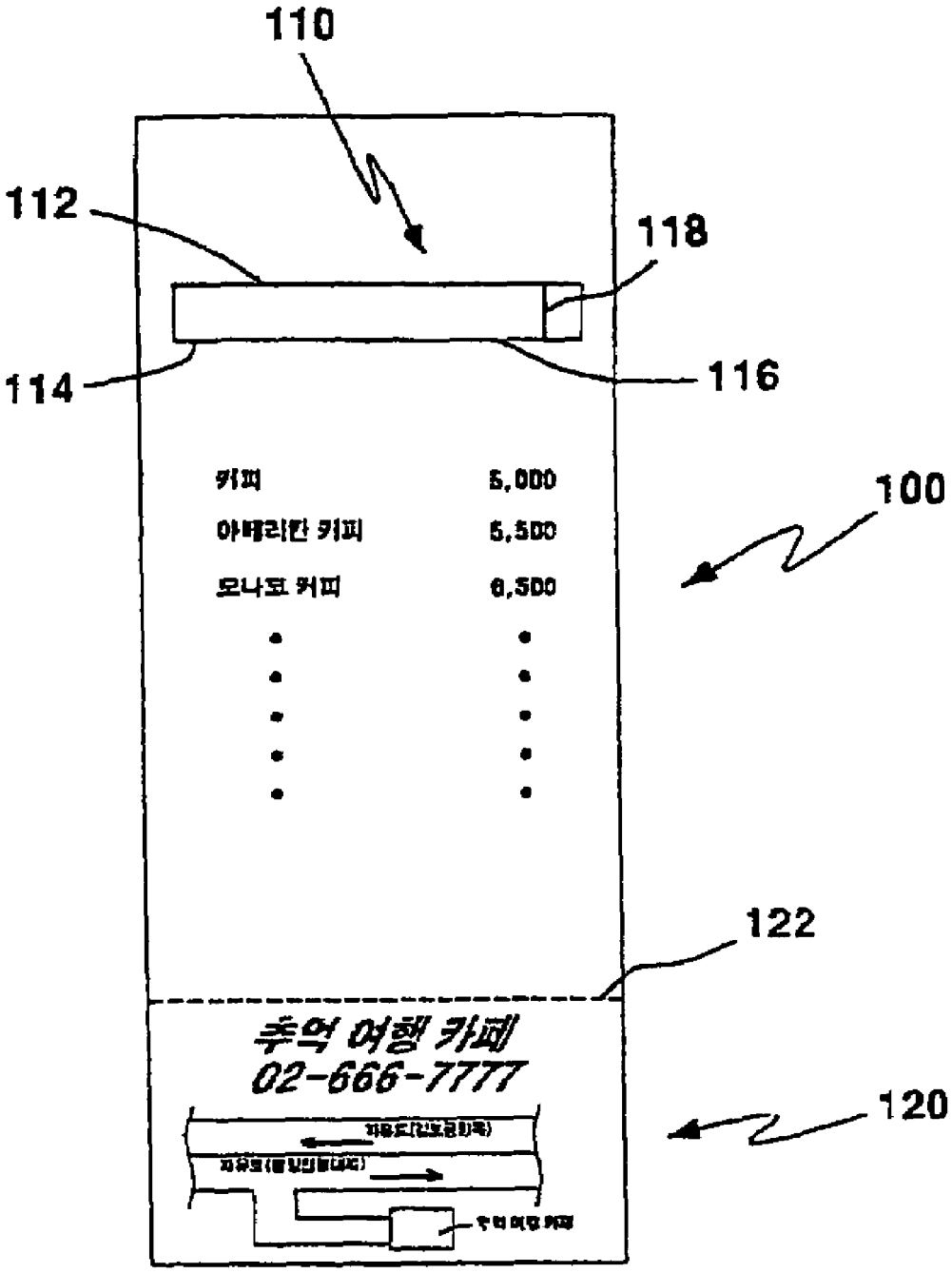
FIG. 2 illustrates a top plan view of an unassembled utensil support apparatus according to one embodiment of the present invention.

FIG. 2 illustrates an unassembled utensil support apparatus 100 according to one embodiment of the present invention. The apparatus 100 preferably has a rectangular shape to facilitate of construction. However, alternative forms, such as rounded and other polygonal shapes, for example, may be used. The apparatus 100 may be constructed of cellulose pulp (such as paper or cardboard), polymer, and other materials known well in the art such that the apparatus 100 is considered disposable. Furthermore, prior to use, a plurality of the apparatus 100 can be stacked in sheets, thereby facilitating storage.

Figure 3:
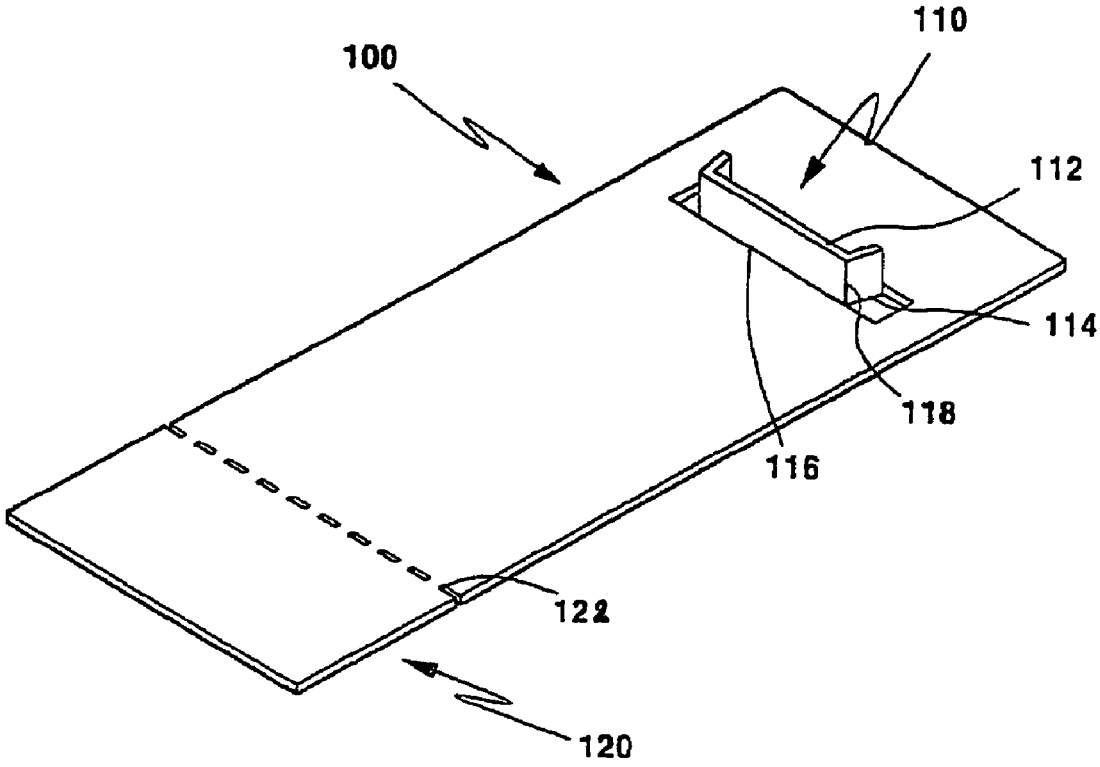
FIG. 3 illustrates a perspective view of an assembled utensil support apparatus according to one embodiment of the present invention.

A utensil supporting section 110 is preferably formed at an upper end of the apparatus 100 so as to prevent the portions of the utensils that contact food from contacting any other surfaces. An advertisement section 120 is preferably formed at a lower end of the apparatus 100 and is preferably detachable by perforation. In FIGS. 2 and 3, a user may remove the advertising section 120 by tearing at the perforation line 122. The eating establishment that is providing the utensil support apparatus 100 (or other vendors that have contracted with the eating establishment for marketing services) may place name, contact and service information on the section 120, for example. The advertisement section preferably has a size approximate to a conventional business card. Alternatively, the advertisement section 120 need not be detachable, wherein the apparatus 100 acts as the advertisement section. Furthermore, the portion of the apparatus 100 between the supporting section 110 and the advertisement section 120 may include additional information, such as more advertising or a menu, as shown in FIG. 2, for example.

Referring to FIGS. 2 and 3, the utensil supporting section 110 comprises four edges, wherein the upper horizontal edge 112 and side edges 114 are incised and separated from the apparatus 100. Alternatively, the edges 112 and 114 can be perforated and a user tears the edges 112 and 114 at the perforations after commencing use of the utensils. A user folds the supporting section 110 at a crease formed on the lower edge 116 so that the supporting section 110 is approximately perpendicular to the apparatus 100 at an elevation view. Creases 118 are formed approximate to the side edges 114 to form outer sections at opposing sides of the supporting section 110. The outer sections are folded so that they are approximately perpendicular to the center section of the supporting section 110 at a plan view. The folded sections provided support so that the supporting section 110 does not decline towards a horizontal state during use. Preferably the creases 116 and 118 are formed during manufacture of the apparatus 100 to facilitate assembly of the apparatus 100. Alternatively, the supporting section can fold at a crease formed at the upper edge 112, wherein the lower edge 116 is incised.

Figure 4:
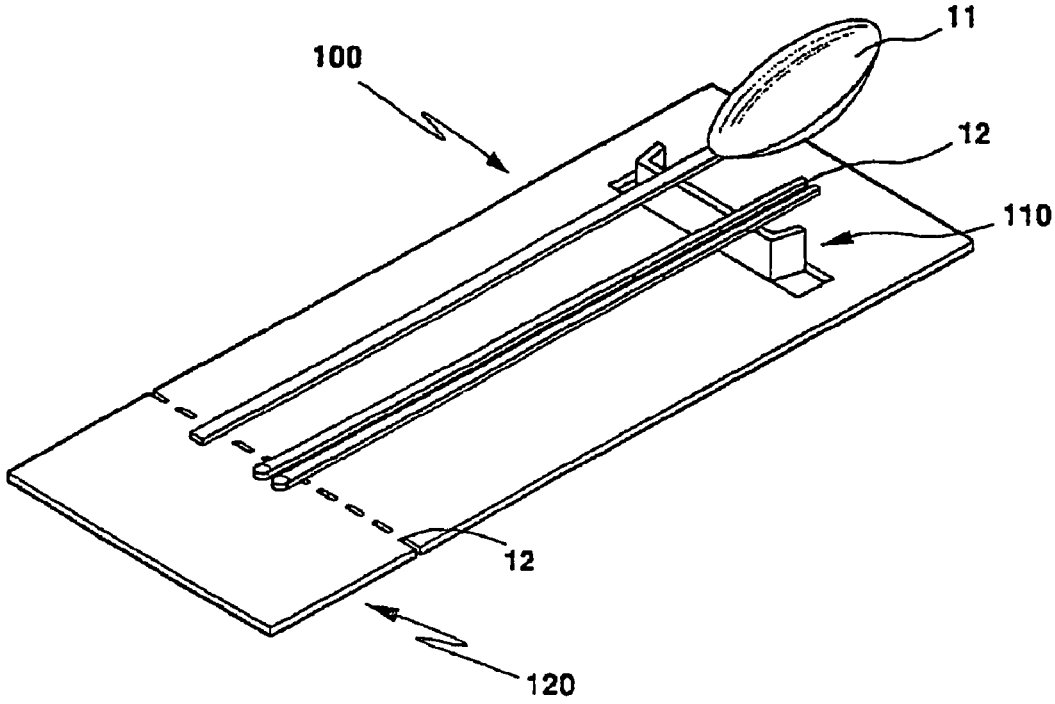
FIG. 4 illustrates a perspective view of an assembled utensil support apparatus in use, according to one embodiment of the present invention.

In FIG. 4, the apparatus 100 is shown as assembled and in use. For example, a spoon 11 and a pair of chop sticks 12 are set on the apparatus 100 so as to prevent contact with the surface of a table or counter. The portions of the utensils 11 and 12 that contact food and the user's mouth are further raised by the supporting section 110. The supporting section 110 prevents the portions of the utensils that contact food and the user's mouth from contacting surfaces where excess food stuffs may have been deposited by resting utensils.

Figure 5:
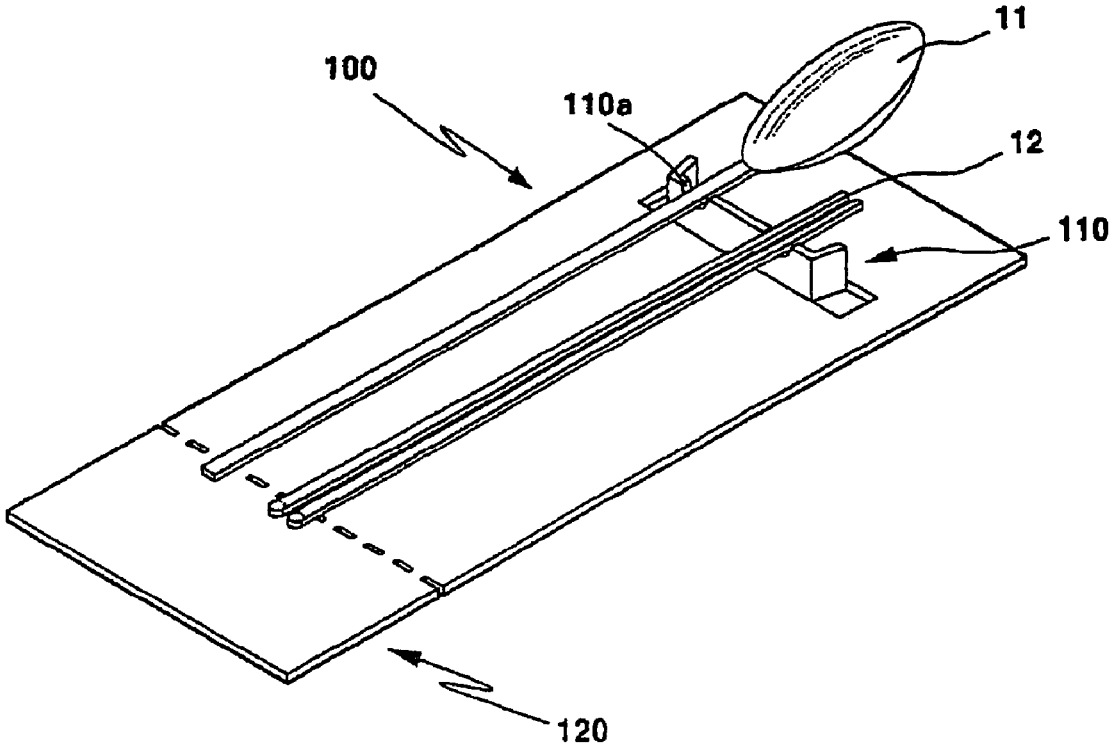
FIG. 5 illustrates a perspective view of an assembled utensil support apparatus in use, according to an alternative embodiment of the present invention.

Referring to FIG. 5, an alternative embodiment to the present invention is shown, wherein grooves 110*a* are formed on the upper edge 112 of the supporting section 110. The grooves 110*a* are formed to accommodate the utensils 11 and 12 and to prevent their lateral movement across the supporting section 110. Accordingly, accidental movement of the table or of the apparatus 100 would not result in the utensils falling and contacting the table top. The width of the grooves 110*a* may vary according to the width of the utensils to be supplied to the patron.

It will be apparent to those skilled in the art that various modifications and variations can be made in the present invention without departing from the spirit or scope of the invention. Therefore, the foregoing description of these embodiments of the present invention has been presented for the purposes of illustration and description. It is not intended to be exhaustive or to limit the invention to the precise form disclosed. Thus, it is intended that the present invention cover the modifications and variations of this invention provided they come within the scope of the appended claims and their equivalents. Preferred embodiments were shown in the context of eating utensils. In alternative embodiments, other utensils such as surgical tools can be substituted for the present invention.

What is claimed is:

1. A utensil support apparatus comprising:

a main body;

a utensil supporting section formed on the main body, wherein the utensil supporting section is assembled prior to supporting a utensil; and an advertising section formed on the main body and distal from the utensil supporting section, wherein the advertising section is detachable from the main body and the utensil support apparatus maintains functionality even upon the advertising section being detached from the main body, wherein the utensil supporting section comprises:

a first lateral edge that is separable from the main body;

a pair of opposing, longitudinal edges that are separable from the main body and form an opening in the main body; and a second lateral edge, wherein the utensil supporting section is folded at the second lateral edge so that the utensil supporting section is approximately perpendicular to the main body, wherein the longitudinal edges press against an edge of the opening to support the utensil supporting section.

2. The apparatus of claim 1, wherein a crease is formed at the second lateral edge.

3. The apparatus of claim 1, wherein a longitudinal crease is formed proximately to each of the pair of opposing, longitudinal edges to form a pair of outer sections to be folded approximately perpendicular to a central section of the utensil supporting section.

4. The apparatus of claim 1, wherein at least one groove is formed on the first lateral edge to accommodate at least one utensil.

5. The apparatus of claim 1, wherein the first lateral edge, the pair of opposing, longitudinal edges, and the advertising section are perforated.

6. The apparatus of claim 1, wherein an advertising section is approximately a size of a business card.

7. A utensil support apparatus comprising:

a main body;

a utensil supporting section formed on the main body, wherein the utensil supporting section is assembled prior to supporting a utensil; and an advertising section formed on the main body and distal from the utensil supporting section, wherein the advertising section is detachable from the main body and the utensil support apparatus maintains functionality even upon the advertising section being detached from the main body, wherein the utensil supporting section comprises:

a first lateral edge that is separable from the main body;

a pair of opposing, longitudinal edges that are incised in the main body and separable from the main body to create an opening in the main body; and a second lateral edge for folding the utensil supporting section to position the utensil supporting section approximately perpendicular to the main body, and wherein the pair of opposing longitudinal edges press against an edge of the opening to support the utensil supporting section.

8. the apparatus of claim 7, wherein the main body has a perforation to facilitate the detachment of the advertising section.

9. The apparatus of claim 7, further comprising cellulose pulp.

* * * * *